US008337276B2

(12) United States Patent
Rossignol et al.

(10) Patent No.: US 8,337,276 B2
(45) Date of Patent: Dec. 25, 2012

(54) AUTOMATED DETECTION OF CHARACTERISTICS OF ABRASIVE PRODUCTS DURING USE

(75) Inventors: Lionel Rossignol, Saratoga Springs, NY (US); Christophe C. Oliver, Dover, MA (US)

(73) Assignees: Saint-Gobain Abrasives, Inc., Worcester, MA (US); Saint-Gobain Abrasifs, Conflans-Sainte-Honorine ( * ) Notice: Subject to any disclaimer, the term of this patent is extended or adjusted under 35 U.S.C. 154(b) by 967 days.

(21) Appl. No.: 12/220,309

(22) Filed: Jul. 22, 2008

(65) Prior Publication Data

US 2009/0036027 A1 Feb. 5, 2009

Related U.S. Application Data

(60) Provisional application No. 60/962,278, filed on Jul. 27, 2007, provisional application No. 60/994,744, filed on Sep. 21, 2007.

(51) Int. Cl.
*B24B 49/00* (2012.01)
*B24B 51/00* (2006.01)

(52) U.S. Cl. ..... 451/5; 382/152; 451/9; 451/10; 451/59; 451/527

(58) Field of Classification Search ..... 382/152; 451/5, 8, 9, 10, 11, 59, 527, 539
See application file for complete search history.

(56) References Cited

U.S. PATENT DOCUMENTS

| | | | |
|---|---|---|---|
| 2,215,210 | A | 9/1940 | Dahlstrom |
| 2,391,731 | A | 5/1943 | Miller et al. |
| 2,733,181 | A | 1/1956 | Riedesel |
| 3,053,020 | A | 9/1962 | Bratton |
| 3,154,897 | A | 11/1964 | Howard |
| 3,427,765 | A | 2/1969 | McGarvey |
| 3,564,782 | A | 2/1971 | Haywood |
| 3,729,873 | A | 5/1973 | Sandell |
| 3,872,629 | A | 3/1975 | Malloy |
| 4,024,302 | A | 5/1977 | Takagi et al. |
| 5,470,362 | A | 11/1995 | Gorsuch et al. |
| 5,951,383 | A | 9/1999 | Eisenblaetter |
| 6,264,533 | B1 | 7/2001 | Kummeth et al. |

(Continued)

FOREIGN PATENT DOCUMENTS

| | | | |
|---|---|---|---|
| DE | 41 11 016 | C1 | 7/1992 |
| WO | WO 00/73020 | A1 | 12/2000 |
| WO | WO 02/062531 | A1 | 8/2002 |

OTHER PUBLICATIONS

Written Opinion of the International Searching Authority, International Application No. PCT/US2008/070745, Date of Mailing: Oct. 28, 2008.

(Continued)

*Primary Examiner* — Timothy V Eley

(74) *Attorney, Agent, or Firm* — Abel Law Group, LLP; Joseph P. Sullivan

(57) ABSTRACT

A method of processing an article with a coated abrasive product, including a repeat of a single marking, comprises detecting at least two characteristics of the repeat of a single marking. The repeat is placed along the length of the abrasive product at a first major surface, wherein each of the detected characteristics conveys independent information regarding the abrasive product. The method further includes comparing the information to a database. A method of acquiring information of the coated abrasive product includes detection and comparing steps.

38 Claims, 5 Drawing Sheets

U.S. PATENT DOCUMENTS

| | | | | |
|---|---|---|---|---|
| 6,616,513 | B1 | 9/2003 | Osterheld et al. | |
| 6,627,024 | B2 | 9/2003 | Lane | |
| 7,014,538 | B2 * | 3/2006 | Tietz et al. | 451/56 |
| 7,052,426 | B2 | 5/2006 | Battat et al. | |
| 7,326,330 | B2 | 2/2008 | Herrington et al. | |
| 7,604,527 | B2 * | 10/2009 | Elledge | 451/6 |
| 2001/0039076 | A1 | 11/2001 | Hashimoto | |
| 2005/0085167 | A1 | 4/2005 | Swei et al. | |
| 2007/0144677 | A1 | 6/2007 | Rawlings | |
| 2009/0029628 | A1 | 1/2009 | Oliver et al. | |

OTHER PUBLICATIONS

Written Opinion of the International Searching Authority, International Application No. PCT/US2008/07046, Date of Mailing: Oct. 28, 2008.

International Preliminary Report on Patentability, International Application No. PCT/US2008/070746, Date of Issuance: Feb. 2, 2010.

International Preliminary Report on Patentability, International Application No. PCT/US2008/070745, Date of Issuance: Feb. 2, 2010.

International Search Report for International Application No. PCT/US2008/070745 dated Oct. 28, 2008.

International Search Report for International Application No. PCT/US2008/070746 dated Oct. 28, 2008.

Universal Product Code, Universal Product Code—Wikipedia, the free encyclopedia [online], Jun. 2007 [retrieved on Jun. 15, 2007]. Retrieved from the Internet URL: http://en.wikipedia.org/wiki/UPC_bar_code.

* cited by examiner

AUTOMATED DETECTION OF CHARACTERISTICS OF ABRASIVE PRODUCTS DURING USE

RELATED APPLICATIONS

This utility application claims the benefit of U.S. Provisional Application No. 60/962,278, filed on Jul. 27, 2007, and U.S. Provisional Application No. 60/994,744, filed on Sep. 21, 2007, the entire teachings of which are incorporated herein by reference.

BACKGROUND OF THE INVENTION

Various types of automated processing systems have been developed to abrasively process articles of various compositions and configurations. For example, coated abrasive strips, rolls or tapes, fed from automatic abrasive feed machines are employed to process parts, such as automobile and powertrain parts (e.g., crankshaft, camshaft, transmission shaft, steering shaft, steering rod). Although conventional automatic abrasive feed machinery systems provide some degree of automation, certain aspects remain manual, and are prone to error, such as proper loading of rolls of abrasive onto feed machines, including the type of abrasive for the part to be processed, and orientation of the roll. Manual examination and verification is time consuming and costly. Errors caused by operators can have very deleterious results, resulting in significant waste during manufacture.

Therefore, there is a need for methods of acquiring information about coated abrasive products, in particular, coated abrasive products fed from automatic abrasive feed machines during processing of articles, that significantly reduces or eliminates these problems.

SUMMARY OF THE INVENTION

The present invention generally relates to a method of processing an article with a coated abrasive product, to a method of acquiring information of such a coated abrasive product, and to a method of preparing a first coated abrasive product and a second coated abrasive product, wherein grain sizes of the first and second abrasive products are different from each other.

In one embodiment, the present invention is directed to a method of processing an article with a coated abrasive product, including a repeat of a single marking. The method includes detecting at least two characteristics of the repeat of a single marking. The repeat is placed along the length of the abrasive product at a first major surface of the abrasive product, wherein each of the detected characteristics conveys independent information regarding the abrasive product. The method further includes comparing the information to a database.

In another embodiment, the present invention is directed to a method of acquiring information of a coated abrasive product that includes a repeat of a single marking. The repeat is placed along the length of the abrasive product at a first major surface of the abrasive product. The method includes detecting at least two characteristics of the repeat of a single marking, each of the detected characteristics conveying independent information regarding the abrasive product. The method further includes comparing the information to a database.

The present invention has many advantages. For example, various types of information about an abrasive product to be employed in processing an article can be easily obtained from a repeating mark on the abrasive product. Since each characteristic detected by a method of the invention conveys independent information, more than one type of information regarding the abrasive product (e.g., product identification, the end of the product, the orientation of the product, etc.) can be obtained from the single marking repeat. Verification and control of abrasive products is greatly simplified by detecting information about the product from a single repeating mark.

DETAILED DESCRIPTION OF THE INVENTION

Figure 1A:
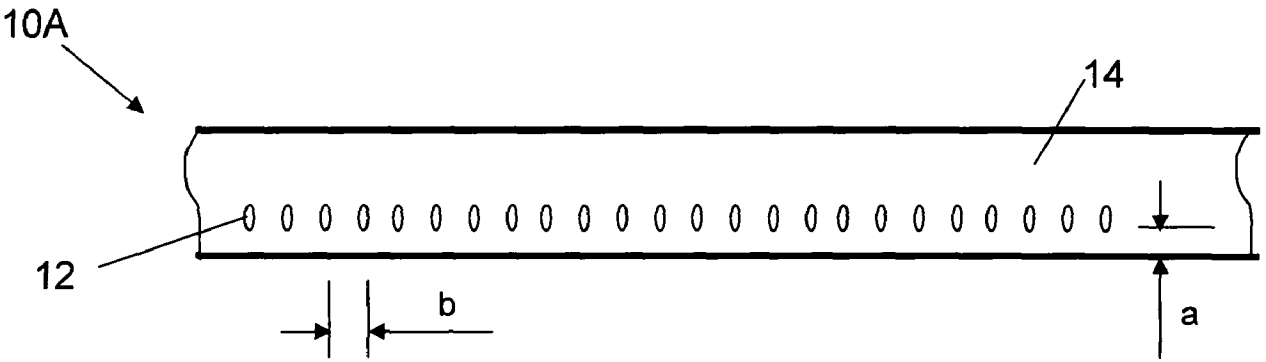
FIG. 1A is a schematic drawing showing one embodiment of a coated abrasive product that can be employed in the invention.

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

The present invention employs a repeat of a single marking embedded in an abrasive product, such as a micro-finishing roll or film, to automatically provide information regarding characteristics of the product (e.g., product type, grain size, abrasive side identification and size of the product) and process needs (e.g., indexing, breakage of the abrasive product, the end of the abrasive product, etc.).

Figure 1B:
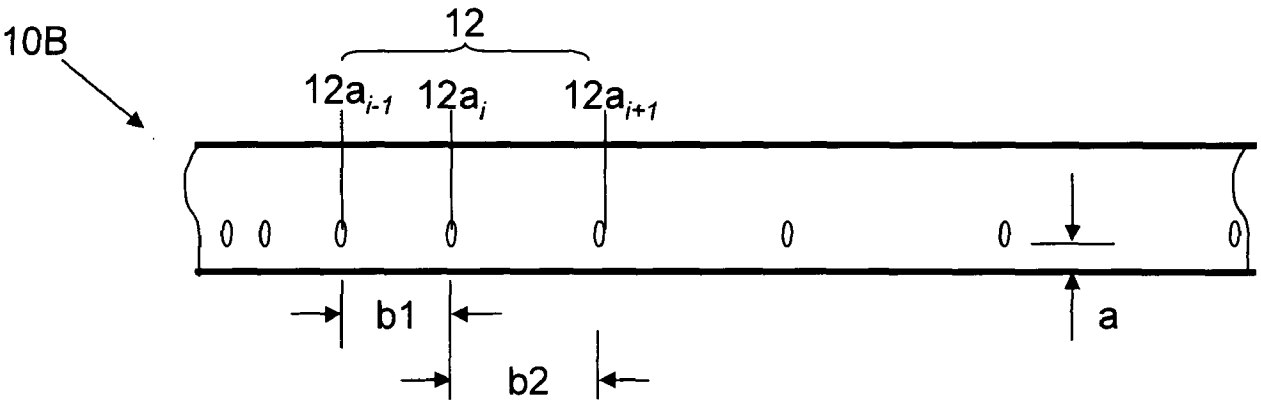
FIG. 1B is a schematic drawing showing another embodiment of a coated abrasive product that can be employed in the invention.

FIGS. 1A and 1B show abrasive product 10 (collectively referred to for abrasive products 10A and 10B) that is employed in one embodiment of the invention. As shown in the figure, abrasive product 10 includes a repeat of single marking 12 along the length of abrasive product 10 at its major surface 14. Preferably, the repeat of single marking 12 is placed essentially throughout the length of abrasive product 10. As used herein, "essentially throughout the length" of the abrasive product means throughout at least about 50% of the length of the abrasive product. More preferably, the repeat of single marking 12 is placed throughout at least about 75% of the length of abrasive product. Even more preferably, the repeat of single marking 12 is placed throughout at least about 90%, such as at least about 95%, of the length of the abrasive product.

Although single marking 12 is depicted as an oval shape in FIGS. 1A and 1B, any suitable shape can be used. Such examples include a circle, a rectangle, a square, a triangle, a diamond, a star, a polygon (including at least, e.g., a pentagon, a hexagon and an octagon) and any user-defined arbitrary shape. Single markings 12 suitable for use in the invention include protrusions, depressions, holes, voids, color or pigment variations, and magnetic or electric markings. Preferably, single marking 12 is a hole, a protrusion, a stripe print, a letter print (e.g. "A") or a number print (e.g., "3"). More preferably, single marking 12 is a hole or a protrusion.

In one embodiment, as shown in FIG. 1A, the repeat of single marking 12 is periodic. In another embodiment, as shown in FIG. 1B, the repeat of single marking 12 is non-periodic. In one example of such non-periodic repeat of single marking 12, the distance between single markings 12 (indicated with reference character "b" in FIG. 1B) is incrementally increased from the beginning to the end of the repeat. Preferably, the increment is regular, such as the distance between markings $\mathbf{12}a_i$ and $\mathbf{12}a_{i+1}$ (indicated with reference character "b2" in FIG. 1B) is a factor longer (e.g., 1.5×, or 2×, or 3×, etc.) than the distance between markings $\mathbf{12}a_i$ and $\mathbf{12}a_{i-1}$ (indicated with reference character "b1" in FIG. 1B).

In some embodiments of the invention, the repeat of single markings 12 is not a bar code. A "bar code," as used herein, means a marking system that employs a combination of at least two discernable features to communicate a single piece of information, such as a combination of two different markings to communicate a single number. A bar code is typically characterized by combinations of bars of different size and/or color (whether, of a single shape, or combination, such as a combination of a "black bar" and a "white bar" or space between bars), as opposed to a single repeating mark, such as a single bar, a square, or a circle. In this system, each feature, alone, cannot communicate a single piece of independent information regarding an abrasive product.

In the method of the invention, at least two characteristics of the repeat of single marking 12 are detected. Each of the detected characteristics conveys independent information regarding the abrasive product. The information conveyed by each characteristic is independent from each other. Examples of characteristics of the repeat of single marking 12 includes shape of single marking 12, dimension of single marking 12, color of single marking 12, distance of single marking 12 from an edge along the length of abrasive product 10 (indicated with character "a" in FIGS. 1A and 1B), distance between single markings 12 (indicated with character "b" in FIGS. 1A and 1B), and number of single markings 12. One or more of these characteristics independently convey information regarding abrasive product 10, including identification information (e.g., product type, grain size, width, manufacturer, etc.) and process needs (e.g., abrasive side identification, index, rupture or breakage of the abrasive product, end of the abrasive product, etc.) for processing an article with abrasive product 10. For example, the shape of single marking 12 can indicate the grain size of the abrasive, while the distance between the markings can indicate the manufacturer of the abrasive product.

Figure 2:
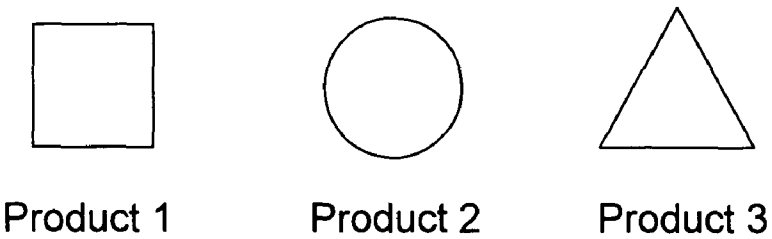
FIG. 2 is a schematic drawing showing various types of single markings that can be employed in the invention.
Figure 3:
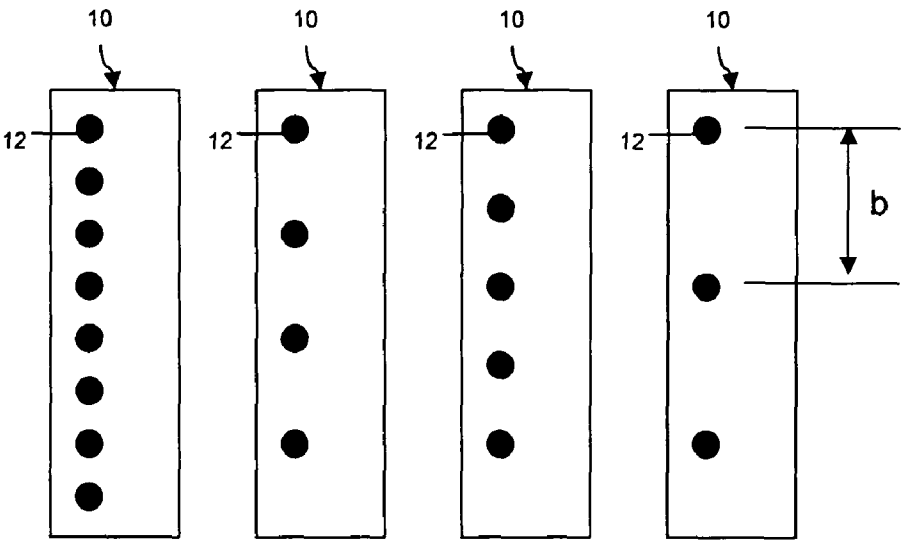
FIG. 3 is a schematic drawing showing various types of repeats of single markings that can be employed in the invention.

In one specific embodiment, characteristics of the repeat convey at least one piece of information selected from the group consisting of product type, grain size, identification of abrasive side, width of abrasive product 10 (e.g., roll width), index, rupture of abrasive product (e.g., roll rupture), and the end of abrasive product 10 (e.g., the end of roll). Preferably, at least one of the shape of single marking 12, the color of single marking 12, the dimension of single marking 12, the distance of single marking 12 from an edge along the length of abrasive product 10, the distance between single markings 12, and the number of the single markings 12 independently convey identification information of abrasive product 10. For example, as shown in FIG. 2, different shapes of single marking 12 are employed to distinguish one abrasive product to another, which have different grades (e.g., different grit sizes) of, e.g., micro-finishing films: a square represents product "Product 1", a circle represents product "Product 2", and a triangle represents product "Product 3". In another example, as shown in FIG. 3, information regarding grain sizes of abrasive products 10 are coded using different distances between single markings 12. For example, the density of single markings corresponds to a value of a fixed dimension (or distance) in millimeters divided by the grit size in microns.

In a specific embodiment, a distinct repeat of single marking 12 is employed to distinguish first and second abrasive products from each other. For example, the first and second abrasive products can be different from each other in at least one characteristic selected from the group consisting of grain size, type of abrasive grains, substrate, binder, coating type, and number of coatings. Preferably, at least one of the shape of single marking 12, the color of single marking 12, the dimension of single marking 12, the distance of single marking 12 from an edge along the length of each abrasive product, the distance between single markings 12 is employed to distinguish the first and second abrasive products from each other.

Figure 4:
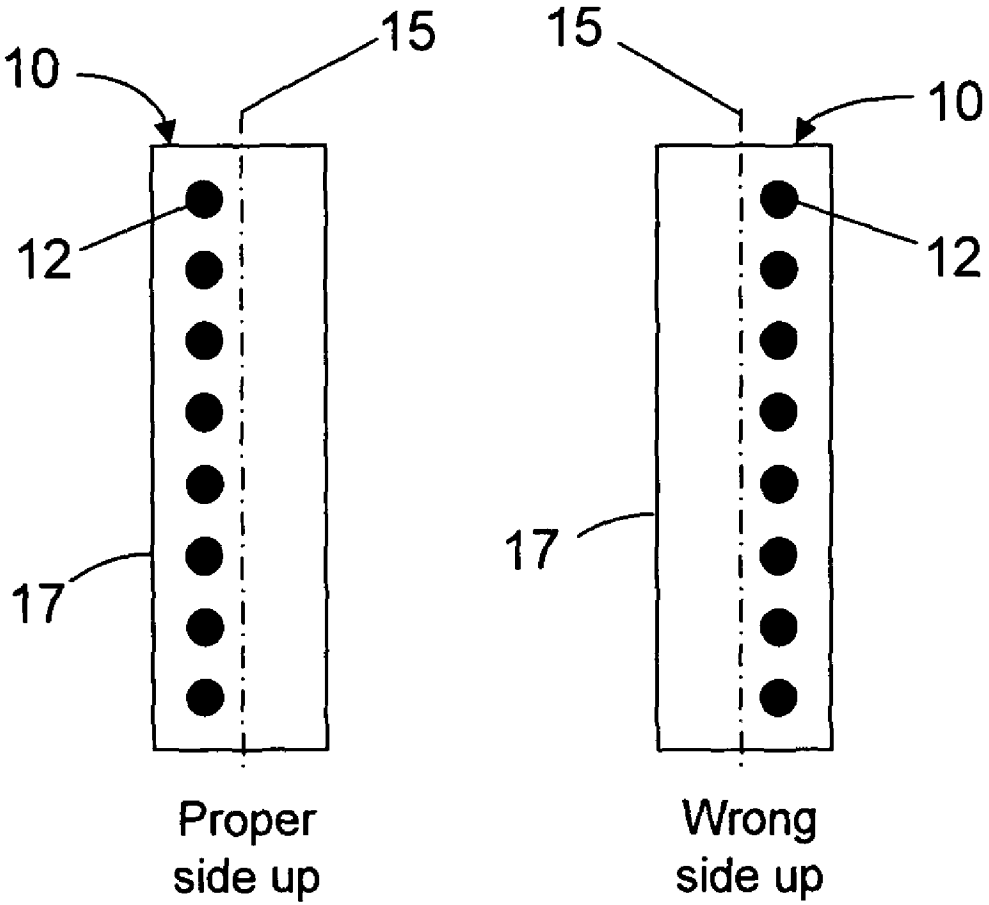
FIG. 4 is a schematic drawing showing one embodiment of a method of the invention to identify the abrasive side of a coated abrasive product, using a repeat of single markings embedded in the coated abrasive product.

In one embodiment, identification of an abrasive side, i.e., a surface having abrasive grains, can be determined by reading the repeat of single markings 12. For example, as shown in FIG. 4, the abrasive side can be determined by the position of single markings 12 with respect to edge 17 and center line 15 of abrasive product 10.

Figure 5:
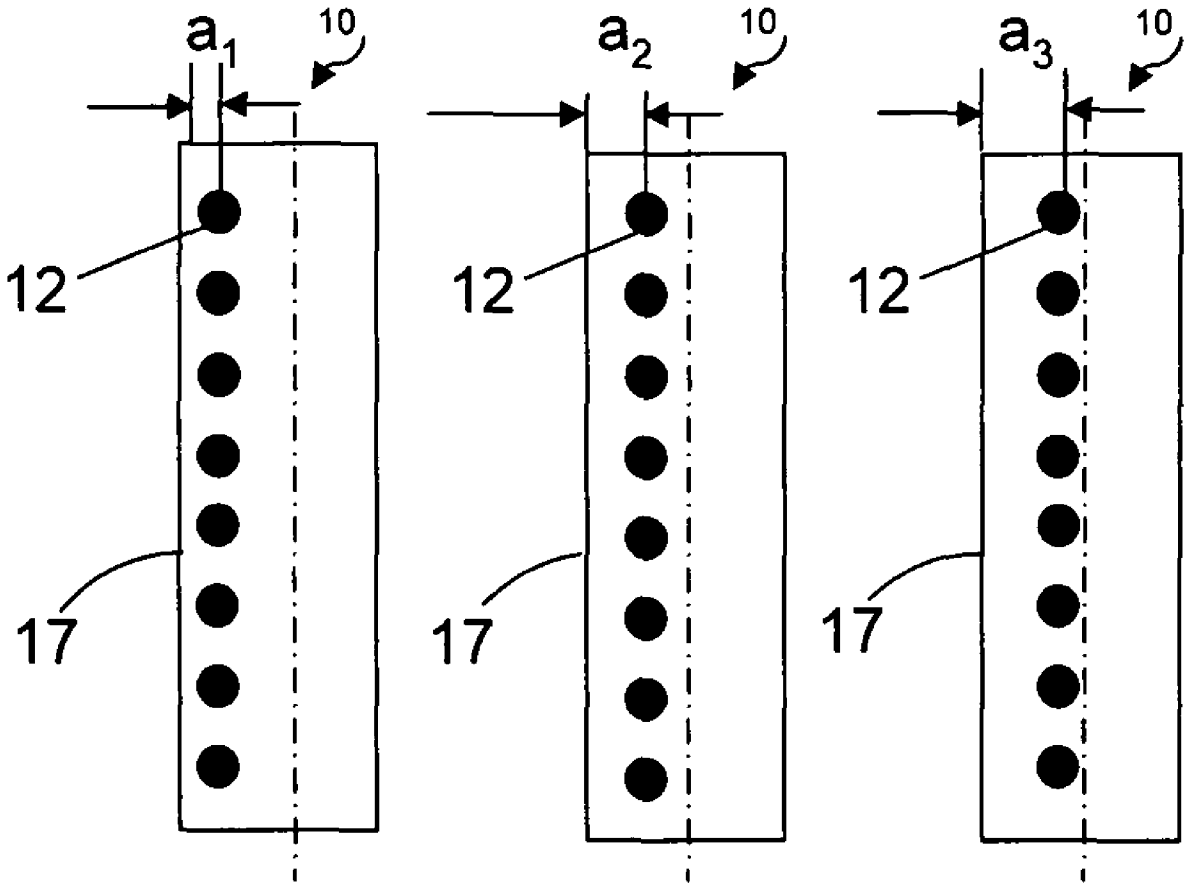
FIG. 5 is a schematic drawing showing one embodiment of a method of the invention to measure the degree of indexing of a coated abrasive product, using a repeat of single markings embedded in the coated abrasive product.

Referring to FIG. 5, in another embodiment, the width of abrasive product 10 can be determined by detecting the distance of single markings 12 from edge 17, e.g., $a_1$, $a_2$ or $a_3$. In a specific embodiment, abrasive products 10, having different widths from each other, are loaded on the same machine, and the distances of single markings 12 from edge 17 (e.g., $a_1$, $a_2$ or $a_3$) of the products are different from each other. Thus, by detecting the distances of single markings 12 from edge 17 (e.g., $a_1$, $a_2$ or $a_3$), verification can be made regarding whether or not the right abrasive product is mounted on the machine for the process of interest.

Although not shown, characteristics, such as dimensions, colors, etc., other than the shape of single markings 12, distance between single markings 12, distance of single markings 12 from an edge of abrasive product, can also be used in the invention for conveying product information.

Figure 6:
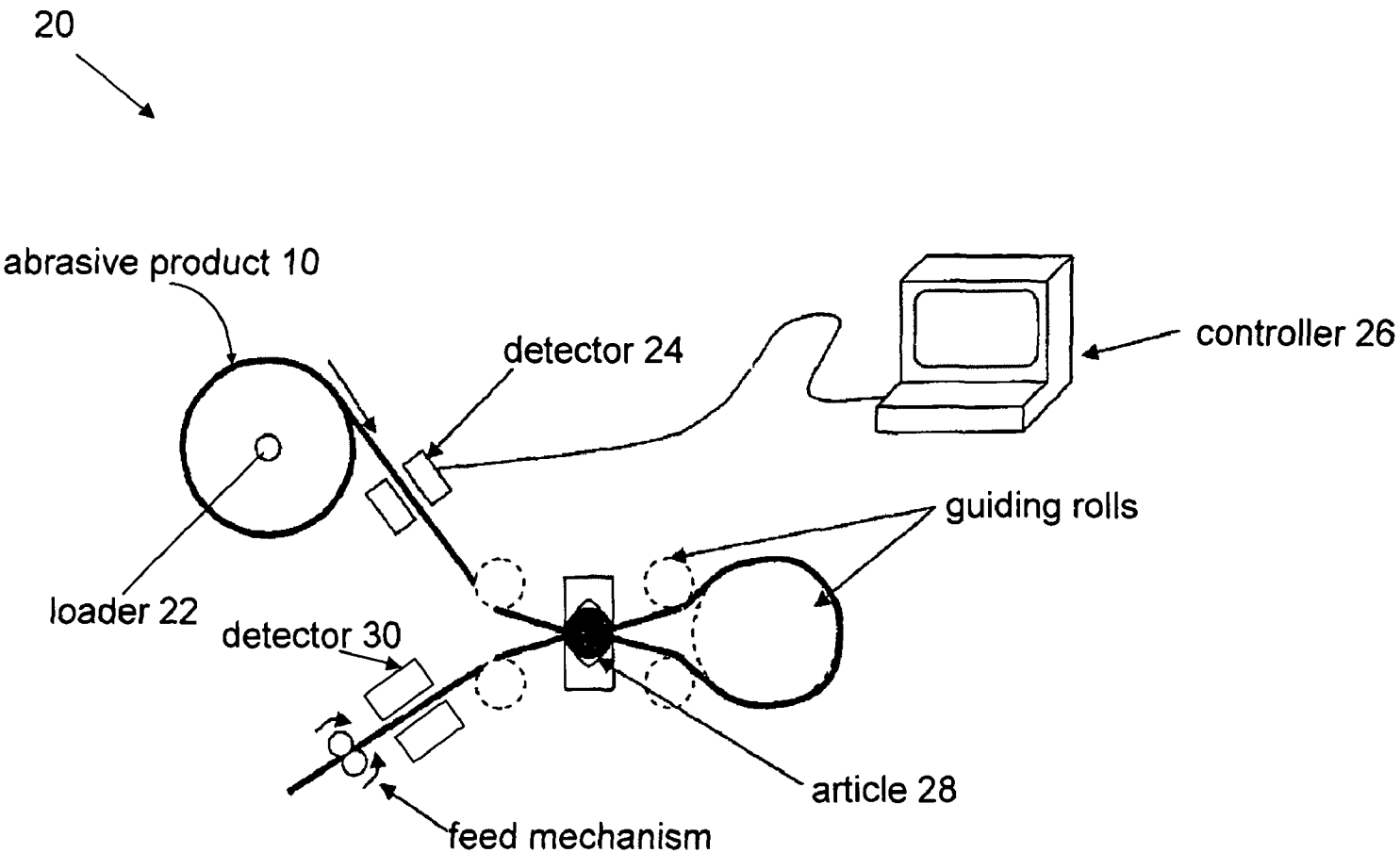
FIG. 6 is a schematic drawing showing a processing system for which a method of the invention can be employed.

FIG. 6 shows automatic processing system 20 where abrasive product 10 is loaded at loader 22 for processing an article 28, such as a part of an automobile, or a powertrain part (e.g., crankshaft, camshaft, transmission shaft, steering shaft, steering rod). Characteristics of the repeat of single markings 12 of abrasive product 10 is detected by detector system 24. The detected characteristics are correlated with particular information in a database of controller 26, such that each of the detected characteristics conveys independent information regarding abrasive product 10. The information is then compared to the database of controller 26.

The repeat of single markings 12 can be machine or human discernable, or both machine and human discernable. Preferably, the repeat of single markings 12 is at least machine discernable. Any suitable detecting mechanisms known in the art can be employed for detector system 24 in the invention. Examples include optical, electrical, magnetic characterization systems known in the art. Preferably, detector system 24 is an optical characterization system. More preferably, the optical detector system includes a guiding system, a source of light behind the product, a sensor capable of identifying characteristics of single markings 12, and/or a controller that performs image analysis.

In a preferred embodiment, controller 26, using the information conveyed by each of the detected characteristics, provides verification of whether or not abrasive product 10 is appropriate for article 28 to be processed. As used herein, the "appropriate" means that abrasive product 10 that is loaded at loader 22 is the correct abrasive product to be used for processing a specific article 28. For example, the information conveyed by at least one of the detected characteristics verifies that the proper product type (e.g., product "Product 1" in FIG. 2) of abrasive product 10 has been loaded at loader 22 for processing of article 28. In another preferred embodiment, controller 26 disables movement of abrasive product 10, or prevents operation of abrasive product 10, in response to a failure of such verification. The verification can be performed while abrasive product 10 is static or in motion. In a specific embodiment, the verification is performed while abrasive product 10 is static and prior to the initiation of processing article 28 with abrasive product 10.

The degree of indexing of abrasive product 10 can also be measured by the information conveyed by at least one of the detected characteristics of the repeat of single markings 12. In one specific embodiment, the degree of indexing is measured by tracking the amount of abrasive product 10 traveled. The degree of indexing is measured with a count of single markings 12 while the abrasive product 10 travels. Typically, the abrasive product 10 advances a fixed amount which is then recorded in the data base. With a known spacing between the single markings 12 and a known amount of abrasive product 10 to be pulled, it is then straightforward to compare the readings of the degree of indexing by detector 24 to a predetermined amount of indexing contained in the database.

The information conveyed by each of the detected characteristics of the repeat of single markings 12 can also be employed to detect breakage or rupture of abrasive product 10 during processing of article 28. In one specific embodiment, system 20 employs first detector system 24 and second detector system 30, wherein first and second detector systems 24 and 30 are positioned before and after processing an area of article 28, respectively, as shown in FIG. 6. Breakage or rupture of abrasive product 10 at the process region is detected if first detector system 24 senses motion of abrasive product 10 (e.g., detection of single markings 12 is made periodically), while second detector system 30 does not detect such motion. Breakage or rupture of abrasive product 10 at the loading region is detected if first detector system 24 fails to sense any motion of abrasive product 10. In a more specific embodiment, failure of detection of motion of abrasive product can be made by the failure of detection of an incoming single marking 12 after a predetermined time period.

In another specific embodiment, detector system 24 and/or detector system 30 independently counts a number of single markings 12, such as by dividing the length of the roll of the strip of abrasive product by the spacing between single markings 12, or simply by counting of detected single markings to provide the number of single markings 12. In a more specific embodiment, the counted number of single markings 12 is compared to a total number of single markings of coated abrasive product 10 stored in the database of controller 26. This comparison provides information regarding the approach of the end of abrasive product 10, and arrival of the end of abrasive product 10. In another more specific embodiment, controller 26 provides a warning signal of the end of abrasive product 10 after a predetermined number of single markings 12 have been counted. In yet another more specific embodiment, the counting of the number of single markings 12 preferably is performed at a predetermined speed, for example, every 30 seconds or every minute. Thus, the repeat of the single markings is detected by limited observation of the abrasive product, whereby the abrasive product is observed at a frequency that coincides with presence of each repeat of single marking at a point of observation.

Abrasive product 10 that is employed in the invention can be in any form. Preferably, abrasive product 10 is in a roll or belt form. More preferably, abrasive product 10 is a coated abrasive roll, such as rolls of micro-finishing film, lapping film or finishing cloth. Preferably, the coated abrasive roll further includes printed information at a surface opposite the surface that includes the repeat of single markings 12. More preferably, abrasive grains are attached to the surface of the single marking repeat opposite the surface of the printed information. Examples of printed information includes a logo print of a manufacturer or grain size of the abrasive roll. The printed information can be in the form of a periodic repeat, or can be random. The additional printed information, such as a logo print, can be used for identifying the side of the abrasive roll that includes the abrasive grains.

Examples of suitable coated abrasive product 10 that can be employed in the invention generally include a substrate, an abrasive material and at least one binder to hold the abrasive material to the substrate. As used herein, the term "coated abrasive product" encompasses a woven abrasive tool and a nonwoven abrasive tool. In one example, coated abrasive product 10 includes a substrate, which is optionally treated with a presize coat and a make coat overlaying the optional presize coat. Coated abrasive product 10 can further include abrasive particles, or an agglomerate thereof is attached to the maker coat or the presize coat when it is employed. A size coat optionally can be applied over the abrasive particles or an agglomerate. A supersize coat optionally can also be included in coated abrasive product 10. The inclusion of a backsize coat, presize coat, size coat, and/or supersize coat is dependent upon the abrasive product's specific applications.

Any suitable substrate material known in the art can be employed to coat abrasive product 10. The substrate useful in the invention can be rigid, but generally is flexible. Examples include paper, cloth, film, fiber, polymeric materials, nonwoven materials, vulcanized rubber or fiber, etc., or a combination of one or more of these materials, or treated versions thereof. The choice of the substrate material generally depends on the intended application of the coated abrasive product to be formed. As used herein, "nonwoven" means a web of random or directional fibers held together mechanically, chemically, or physically, or any combination of these. Examples of nonwoven materials include fibers formed into a nonwoven web that provides a three-dimensional integrated network structure. Any fibers known to be useful in nonwoven abrasive tools can be employed in the invention. Such fibers generally are formed from various polymers, including polyamides, polyesters, polypropylene, polyethylene and various copolymers thereof. Cotton, wool, blast fibers and various animal hairs can also be used for forming nonwoven fibers. In some applications, the nonwoven substrate can include a collection of loose fibers, to which abrasive powders or agglomerates are added to provide an abrasive web having abrasive powders or agglomerates throughout.

Suitable abrasive materials for use in the invention include diamond, corundum, emery, garnet, chert, quartz, sandstone, chalcedony, flint, quartzite, silica, feldspar, pumice and talc, boron carbide, cubic boron nitride, fused alumina, ceramic aluminum oxide, heat treated aluminum oxide, alumina zirconia, glass, silicon carbide, iron oxides, tantalum carbide, cerium oxide, tin oxide, titanium carbide, synthetic diamond, manganese dioxide, zirconium oxide, and silicon nitride. The abrasive materials can be oriented, or can be applied to the substrate without orientation (i.e., randomly), depending upon the particular desired properties of the coated abrasive tools. In choosing an appropriate abrasive material, characteristics, such as size, hardness, compatibility with workpieces and heat conductivity, are generally considered. Abrasive materials useful in the invention typically have a particle size ranging from about 0.1 micrometer and about 1,500 micrometers, such as from about 10 micrometers to about 1000 micrometers.

In some cases, a supersize coat is employed in an abrasive product of the invention. Generally, the function of a supersize coat is to place on a surface of coated abrasive materials an additive that provides special characteristics, such as enhanced grinding capability, surface lubrication, anti-static properties or anti-loading properties. Examples of suitable grinding aids include $KBF_4$ and calcium carbonate. Examples of suitable lubricants include lithium stearate and the like. Examples of suitable anti-static agent include alkali metal sulfonates, tertiary amines and the like. Examples of suitable anti-loading agents include metal salts of fatty acids, for example, zinc stearate, calcium stearate, lithium stearate, sodium laurel sulfate and the like. Anionic organic surfactants can also be used effective anti-loading agents. A variety of examples of such anionic surfactants and antiloading compositions including such an anionic surfactant are described in U.S. Patent Application Publication No. 2005/0085167 A1, the entire teachings of which are incorporated herein by reference. Other examples of suitable anti-loading agents include inorganic anti-loading agents, such as metal silicates, silicas, metal carbonates and metal sulfates. Examples of such inorganic anti-loading agents can be found in WO 02/062531, the entire teachings of which are incorporated herein by reference.

Single markings 12 can be made by any suitable method known in the art. For example, any suitable printing method known in the art can be used for making print types of single markings 12. Also, any cutting or embossing method known in the art, for example, a laser technique, can be used for making hole, embossment or protrusion types of single markings 12.

EQUIVALENTS

While this invention has been particularly shown and described with references to example embodiments thereof, it will be understood by those skilled in the art that various changes in form and details may be made therein without departing from the scope of the invention encompassed by the appended claims.

What is claimed is:

1. A method of processing an article with a coated abrasive product including a repeat of a single mark, comprising the steps of:

detecting at least two characteristics of the repeat of a single mark, the repeat being placed along the length of the abrasive product at a first major surface, wherein each of the detected characteristics conveys independent information regarding the abrasive product; and comparing the information to information in a database.

2. The method of claim 1, wherein the repeat of the single mark is periodic.

3. The method of claim 1, wherein the characteristics are selected from the group consisting of shape of the single mark, dimension of the single mark, color of the single mark, distance of the single mark from an edge along the length of the abrasive product, distance between the single marks, and number of the single marks.

4. The method of claim 3, wherein the characteristics of the repeat convey at least one piece of information selected from the group consisting of product type, grain size, which side of the coated abrasive product is abrasive, width of the abrasive product, index, film rupture and end of the abrasive product.

5. The method of claim 1, wherein at least one of the detected characteristics convey whether the abrasive product is the correct abrasive product with which the article is to be processed.

6. The method of claim 5, further including the step of preventing movement of the abrasive product if the abrasive product is not the correct abrasive product with which the article is to be processed.

7. The method of claim 5, wherein the detection of whether the abrasive product is correct for the article is performed while the abrasive product is static, and prior to initiation of the processing of the article with the abrasive product.

8. The method of claim 1, wherein the detection of the characteristics of the repeat includes counting a number of the single marks.

9. The method of claim 8, wherein the counted number of the single marks is compared to a total number of the single marks of the coated abrasive product stored in the database to thereby identify the end of the abrasive product.

10. The method of claim 9, further including the step of providing a warning signal that the end of the abrasive product is approaching.

11. The method of claim 10, further including the step of providing the warning signal after a predetermined number of the single marks have been counted.

12. The method of claim 8, wherein counting a number of the single marks is performed by limited observation of the abrasive product, whereby the abrasive product is observed at a predetermined frequency.

13. The method of claim 8, further including the step of detecting rupture of the coated abrasive product by failure of detection of an incoming single mark after a predetermined time period.

14. The method of claim 1, wherein the single mark is selected from the group consisting of a hole, a protrusion, a stripe print, a letter print and a number print.

15. The method of claim 14, wherein the single mark is selected from the group consisting of a hole and a protrusion.

16. The method of claim 15, wherein the hole or protrusion has a shape selected from the group consisting of: a circle, a rectangle, a square, a triangle, an oval, a diamond, a star and a polygon.

17. The method of claim 1, wherein the coated abrasive product is an abrasive roll including abrasive grains, wherein the first major surface of the abrasive product abuts a second major surface of the abrasive product.

18. The method of claim 17, further including the step of identifying a side of the abrasive roll which includes the abrasive grains by reading the repeat.

19. The method of claim 18, wherein the abrasive grains are at the first major surface.

20. The method of claim 19, wherein the abrasive roll further includes printed information at the second major surface.

21. The method of claim 20, wherein the printed information can be selected from the group consisting of a logo print of a manufacturer and an indication of grain size of the abrasive grains at the first major surface of the abrasive roll.

22. The method of claim 21, wherein the printed information is in the form of a periodic repeat.

23. The method of claim 1, wherein the repeat of a single mark extends essentially throughout the length of the abrasive product.

24. A method of acquiring information of a coated abrasive product including a repeat of a single mark in operation, comprising the steps of:

detecting at least two characteristics of the repeat of a single mark, the repeat being placed along the length of the abrasive product at a first major surface, wherein each of the detected characteristics independently conveys information regarding the abrasive product; and comparing the information to information in a database.

25. The method of claim 24, wherein the single mark repeat is periodic.

26. The method of claim 24, wherein the characteristics are selected from the group consisting of shape of the single mark, dimension of the single mark, color of the single mark, distance of the single mark from an edge along the length of the abrasive product, distance between the single marks, and number of the single marks.

27. The method of claim 26, wherein the characteristics of the repeat convey at least one piece of information selected from the group consisting of product type, grain size, which side of the coated abrasive product is abrasive, width of the abrasive product, degree of indexing of the abrasive product, film rupture and end of the abrasive product.

28. The method of claim 24, wherein at least one of the detected characteristics conveys whether the abrasive product is the correct abrasive product with which the article is to be processed.

29. The method of claim 28, wherein the detection of whether the abrasive product is correct for the article is performed while the abrasive product is static, and prior to initiation of the processing of the article with the abrasive product.

30. The method of claim 28, wherein the detection of the characteristics of the repeat includes counting a number of the single marks.

31. The method of claim 30, wherein the counted number of the single marks is compared to a total number of the single marks of the coated abrasive product stored in the database to thereby identify the end of the abrasive product.

32. The method of claim 30, wherein counting a number of the single marks is performed by limited observation of the abrasive product, whereby the abrasive product is observed at a predetermined frequency.

33. The method of claim 30, further including the step of detecting rupture of the coated abrasive product by failure of detection of an incoming single mark after a predetermined time period.

34. The method of claim 24, wherein the single mark is selected from the group consisting of a hole, a protrusion, a stripe print, a letter print and a number print.

35. The method of claim 34, wherein the single mark is selected from the group consisting of a hole and a protrusion.

36. The method of claim 35, wherein the hole or protrusion has a shape selected from the group consisting of: a circle, a rectangle, a square, a triangle, an oval, a diamond, a star and a polygon.

37. The method of claim 24, wherein the coated abrasive product is an abrasive roll, wherein the first major surface of the abrasive product abuts a second major surface of the abrasive product.

38. The method of claim 24, wherein the repeat of a single mark extends essentially throughout the length of the abrasive product.

* * * * *